United States Patent [19]

Lopes

[11] 4,272,933

[45] Jun. 16, 1981

[54] MOBILE HOME ANCHOR

[76] Inventor: Rosario Lopes, 19266 Berden Ave., Harper Woods, Mich. 48225

[21] Appl. No.: 30,272

[22] Filed: Apr. 16, 1979

[51] Int. Cl.[3] ..... E02D 27/32; E02D 5/74

[52] U.S. Cl. ..... 52/149; 52/DIG. 11; 410/85

[58] Field of Search ..... 52/DIG. 11, 23, 148, 52/149; 105/473–481; 248/499; 280/764; 254/78; 410/85

[56] References Cited

U.S. PATENT DOCUMENTS

| | | | |
|---|---|---|---|
| 2,353,017 | 7/1944 | Denton | 105/477 |
| 3,724,151 | 4/1973 | Kaywood et al. | 52/DIG. 11 |

*Primary Examiner*—John E. Murtagh

*Attorney, Agent, or Firm*—Gifford, VanOphem, Sheridan & Sprinkle

[57] ABSTRACT

An improved anchor is provided for use with a mobile home having an underframe and wherein the mobile home is mounted above a base. The anchor comprises a clamping member which engages the mobile home underframe and a chain which is connected at one end to the clamp member and depends downwardly towards the base. The other end of the chain is secured to the parallel legs of a first clevis by a bolt while the base leg of the clevis is secured by a bolt to one end of a turnbuckle. A further bolt extends through the base leg of a second clevis and is in turn secured to the other end of the turnbuckle. The base leg of a third clevis is secured to the mobile home base and is dimensioned so that the parallel legs of the third clevis can slidably receive the parallel legs of the second clevis therebetween. The second and third clevises are secured together by a bolt extending through registering apertures in the parallel legs of both of these clevises to thus secure the mobile home to the base while permitting a pivotal motion between the second and third clevises.

5 Claims, 2 Drawing Figures

MOBILE HOME ANCHOR

BACKGROUND OF THE INVENTION

I. Field of the Invention

The present invention relates generally to hold down or anchoring devices and, more particularly to such a device for use with a mobile home.

II. Description of the Prior Art

Due to their low cost and maximum land space utilization, modular housing has become increasingly popular in our society. Such modular housing is commonly called a mobile home even though such homes are usually transported by a towing truck and semipermanently mounted upon a base at a chosen location. Such mobile homes are oftentimes never again transported except for their original installation.

Despite the relative permanence of a typical mobile home installation, the support for the home is oftentimes make-shift and inadequate. Moreover, since the weight of a typical mobile home is considerably less than that of a conventional dwelling, merely resting the mobile home on jacks or blocks, as is the usual case, does not produce the degree of support or stability to adequately ensure against the mobile home shifting on its base due to normal vibration and/or wind forces.

In order to stabilize these previously known mobile homes on their bases there have been a number of previously known anchoring devices which engage the underframe of the mobile home and secure it to the mobile home base. These previously known mobile home anchors typically comprise a clamp member which is secured to the mobile home underframe and one end of an elongated chain is connected to the clamp member.

An eyebolt is then secured to the other end of the chain and the eyebolt threadably engages one end of a turnbuckle. Likewise, a second eyebolt threadably engages the other end of the turnbuckle and this second eyebolt is interlocked with a third eyebolt. Finally, the third eyebolt is screwed into a suitable threaded fastener secured to or embedded in the mobile home base in order to secure the anchor to the base. Rotation of the turnbuckle, of course, tensions the chain and effectively secures the mobile home to its base.

It has been the practice with the previously known mobile home anchors of this type to weld the open end of the first eyebolt to its shank after its attachment with the chain and to likewise weld the open ends of the second and third eyebolts to their respective shanks after their attachment together. It is necessary to weld the eyebolts closed in this fashion in order to prevent the loops of the eyebolts from stretching apart when the mobile home anchor is subjected to great wind and/or vibration stresses and forces. Such great stresses and forces, however, are often imposed upon the mobile home anchor during high wind storms due to the large surface area of the mobile home.

While welding the open loops of the eyebolts closed has proven effective in operation and use of the mobile home anchor, these welding operations are very expensive to accomplish. For example, in practice the cost of welding the three loops of the eyebolt closed constitutes over fifty (50%) percent of the total manufacturing price of the mobile home anchor.

SUMMARY OF THE PRESENT INVENTION

The present invention provides an improved mobile home anchor which eliminates the necessity of welding the loops of the eyebolts closed without sacrificing the strength of the overall mobile home anchor.

In brief, the mobile home anchor according to the present invention comprises a clamp member which engages the underframe of the mobile home. An elongated chain is secured at one end to the clamp member and depends downwardly towards the mobile home base.

A clevis having a base leg and two outwardly extending and generally parallel legs has its base leg secured to one end of a turnbuckle by a conventional bolt. The other end of the chain is then positioned between the parallel legs of the clevis and a conventional bolt extends through registering apertures in the clevis parallel legs and through one link of the chain. The bolt and its nut thus secure the chain to the upper end of the turnbuckle without the necessity of a welding operation or sacrifice in strength.

A second clevis, similar in construction to the first, has its base leg secured by a conventional bolt to the other or lower end of the turnbuckle. The base leg of a third clevis is then secured to the mobile home base by a bolt which threadably engages a suitable internally threaded fastener embedded in the mobile home base. The third clevis, however, is larger than the second clevis and is dimensioned so that the parallel legs of the second clevis can fit within and between the parallel legs of the third clevis. The outwardly extending legs of the second and third clevises are then secured together by a bolt which extends through registering apertures in the parallel legs of the second and third clevises. The free end of the second clevis, however, is spaced upwardly from the base leg of the third clevis in order to enable pivotal motion between the second and third clevises.

With the mobile home anchor according to the present invention attached between the base and underframe of a mobile home, the anchor is capable of withstanding breaking or stretching even under high wind or vibration conditions. Moreover, the manufacturing cost of the clevises is substantially less than the cost of welding the eyebolts closed on the previously known mobile home anchors.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF THE PRESENT INVENTION

Figure 1:
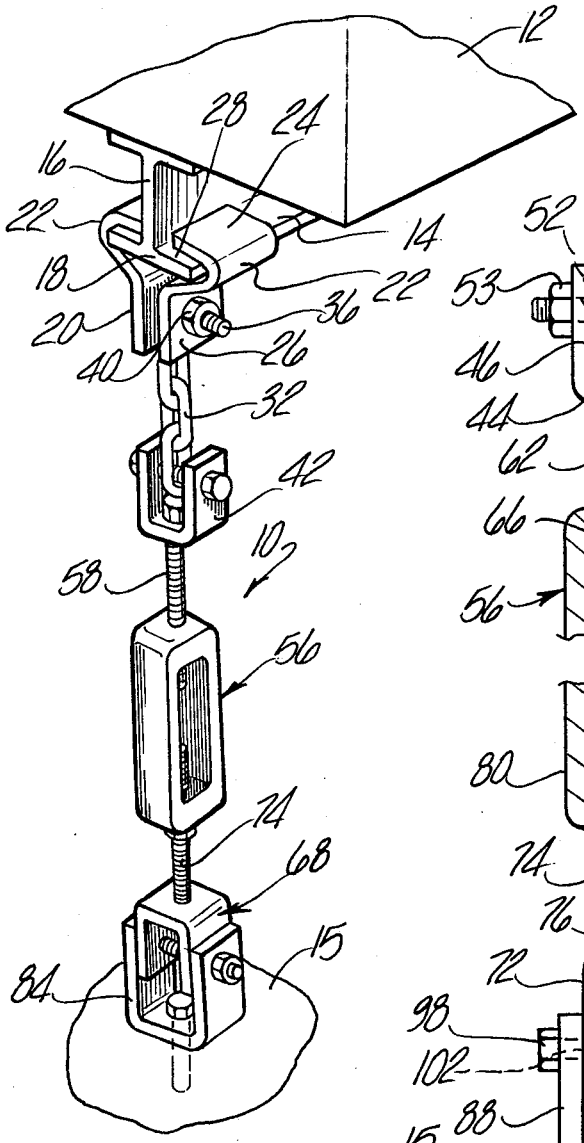
FIG. 1 is a perspective view illustrating the anchor according to the present invention.

With reference first to FIG. 1, the mobile home anchor 10 according to the present invention is thereshown securing a mobile home 12 having an underframe 14 to a base 15. In the conventional fashion, the underframe 14 of the mobile home 12 includes an I-beam 16 having a lower and substantially horizontal flange 18.

The anchor 10 according to the present invention includes a clamp member 20 having a pair of spaced and substantially identical clamping elements 22. Each clamping element 22 includes an upper flange engaging portion 24 and a lower downwardly depending portion 26. The flange engaging portion 24 of the clamp elements 22 engage the upper surface 28 of the I-beam horizontal flange 18 so that the lower portion 26 of the clamping elements 22 depend downwardly in a spaced and substantially parallel relationship to each other.

The mobile home anchor 10 of the present invention further includes an elongated chain 32 having its upper link (not shown) positioned at least partly between the downwardly depending portions 26 of the clamping elements 22. A bolt 36 extends through registering apertures in the clamping elements 22 and also through the upper link of the chain 32 to thereby secure one end of the chain 32 to the clamp member 20. The bolt 36 is secured in place by a nut 40 so that the chain 32 depends downwardly toward the mobile home base 15.

Figure 2:
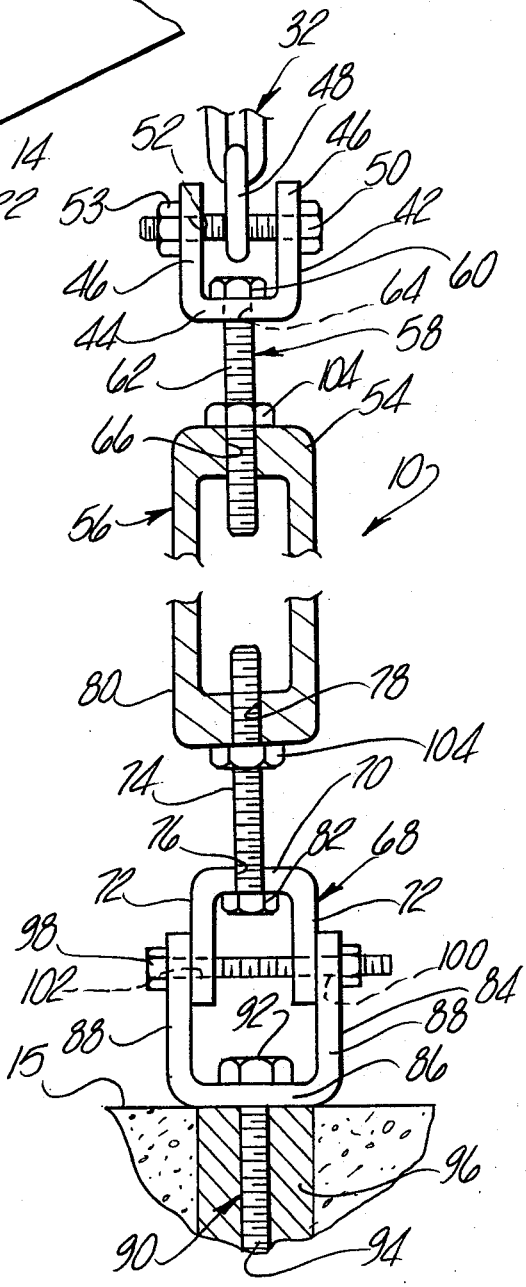
FIG. 2 is a fragmentary side view illustrating the anchor according to the present invention with parts removed and enlarged for clarity.

With reference now to FIG. 2, the mobile home anchor 10 further includes a U-shaped clevis 42 having a base leg 44 and a pair of spaced and parallel end legs 46. The clevis 42 is secured to a lower link 48 on the chain 32 by means of a bolt 50 which extends through registering apertures 52 formed through the parallel legs 46 of the clevis 42 and also through the lower chain link 48. A nut 53 secures the bolt 50 in place.

The first clevis 42 in turn is secured to one end 54 of a turnbuckle 56 by a standard bolt 58. The bolt 58 includes an enlarged head 60 and an elongated threaded shank 62 which extends through an aperture 64 in the base leg 44 of the first clevis 42. The enlarged head 60 of the bolt 58 abuts against the clevis base leg 44 while the threaded shank 62 threadably engages a threaded bore 66 at the end 54 of the turnbuckle 56.

A second clevis 68 is also provided and, like the first clevis 42, includes a base leg 70 and a pair of outwardly extending and generally parallel legs 72. A bolt 74 extends through an aperture 76 in the second clevis base leg 70 and threadably engages a threaded bore 78 at the other end 80 of the turnbuckle 56. In a fashion similar to the first clevis 42, the bolt 74 includes an enlarged head 82 which abuts against the clevis base leg 70 to thereby secure the clevis 68 to the turnbuckle 56.

The mobile home anchor 10 of the present invention further includes a third clevis 84 having a base leg 86 and a pair of outwardly extending and substantially parallel legs 88. The base leg 86 of the third clevis 84 is secured flatly against the mobile home base 15 by a bolt 90 having an enlarged head 92 which abuts against the base leg 86 and an elongated shank 94 which threadably engages an internally threaded fastener 96 embedded in the base 15. Thus, upon tightening of the bolt 90, the third clevis 84 is firmly and rigidly secured to the mobile home base 15.

The third clevis 84, while similar in shape to the second clevis 68, is larger than the second clevis 68 so that the parallel legs 72 of the second clevis 68 are telescopically received in between the parallel legs 88 of the third clevis 84. The second and third clevises are then secured together by a bolt 98 which extends through registering apertures 100 and 102 in the parallel legs of the third clevis 84 and second clevis 68, respectively. A nut locks the bolt 98 in place. Moreover, the free ends of the parallel legs 72 of the second clevis 68 are spaced upwardly from the base leg 86 of the third clevis 84 so that the second and third clevises 68 and 84 can pivot with respect to each other.

In the installation of the mobile home anchor 10 according to the present invention, the second and third clevises 68 and 84 are initially separated from each other. The third clevis 84 is then securely fastened to the mobile home base 16 by the bolt 90 while the clamp 20 is secured to the mobile home underframe 14. The parallel legs of the second and third clevises 68 and 84 are then secured together by the bolt and nut arrangement 98.

Thereafter, the turnbuckle 56 is rotated in order to tension the mobile home anchor 10 and thus securely fasten the mobile home 12 to the base 15. Although some slippage may initially occur between the bolts 58 and 74 and their respective clevises, as the tension on the anchor increases, any such slippage ceases. When the anchor is tensioned as desired, lock nuts 104 are tightened against the turnbuckle 56 and prevent rotation of the bolts 58 and 74.

From the foregoing, it can be seen that the mobile home anchor 10 according to the present invention provides a simple and yet high strength mobile home anchor that is capable of maintaining a mobile home against its base despite high wind and/or vibration conditions. Moreover, the use of the three clevises completely eliminates the need and cost to weld the loops of eyebolts closed as has been the previous practice.

Having described my invention, however, many modifications thereto will become apparent to those skilled in the art to which it pertains without deviation from the spirit of the invention as defined by the scope of the appended claims.

I claim:

1. An anchor for detachably securing a mobile home to and above a base, said mobile home having an underframe, said anchor comprising:

a clamp member, first means for attaching said clamp member to the mobile home underframe, an elongated connecting member secured at one end to the clamp member, a first clevis having a base and a pair of outwardly extending legs, means for securing said first clevis to the other end of said connecting member so that the legs of the first clevis extend upwardly toward said mobile home underframe, a second clevis having a base and a pair of outwardly extending legs, a pair of registering apertures being formed through the outwardly extending legs of the second clevis, means for attaching said second clevis to said base so that the base of the second clevis flatly abuts against said base and so that the legs of said second clevis extend upwardly, a third clevis having a base and a pair of outwardly extending legs, each leg having an aperture formed through it so that said apertures register with each other, the outside width of the legs of the third clevis being less than the inside width between the legs of the second clevis, means extending through the apertures in the legs of said second and third clevis for pivotally securing said second and third clevises together so that the legs of the third clevis extend downward, and tension means for attaching the bases of the first and third clevises together, wherein all of said clevises are of a one-piece construction.

2. The invention as defined in claim 1 wherein said means extending through the apertures in the legs of said second and third clevises comprises a bolt.

3. The invention as defined in claim 1 wherein said tension means further comprises a turnbuckle and means for connecting one end of the turnbuckle to the base of the first clevis and means for connecting the other end of the turnbuckle to the base of the third clevis.

4. The invention as defined in claim 3 wherein said means for connecting said one end of the turnbuckle to the first clevis further comprises a bolt extending through an aperture in the base of the first clevis and threadably engaging one end of the turnbuckle.

5. The invention as defined in claim 1 wherein the free ends of the outwardly extending legs of the third clevis are spaced from the base of the second clevis to thereby permit pivotal motion between the second and third clevises.

* * * * *